United States Patent [19]

Wrobel

[11] Patent Number: 4,734,015

[45] Date of Patent: Mar. 29, 1988

[54] AXIAL-FLOW FAN

[75] Inventor: Guenter Wrobel, Villingen, Fed. Rep. of Germany

[73] Assignee: Papst-Motoren GmbH & Co. KG, St. Georgen, Fed. Rep. of Germany

[21] Appl. No.: 67,389

[22] Filed: Jun. 26, 1987

Related U.S. Application Data

[63] Continuation of Ser. No. 516,733, Jul. 25, 1983, abandoned.

[30] Foreign Application Priority Data

Jul. 24, 1982 [DE] Fed. Rep. of Germany ..... 3227698

[51] Int. Cl.[4] ..... F04D 25/08; F04D 29/44

[52] U.S. Cl. ..... 417/354; 417/423 R; 415/207; 415/213 C

[58] Field of Search ..... 417/352, 353, 354, 423 R; 415/213 C, 182, 207; 416/DIG. 2

[56] References Cited

U.S. PATENT DOCUMENTS

| | | | |
|---|---|---|---|
| 3,229,897 | 1/1966 | Papst | 417/354 |
| 3,334,807 | 8/1967 | McMahan | 416/DIG. 2 |
| 4,164,690 | 8/1979 | Muller et al. | 417/410 |
| 4,167,376 | 9/1979 | Papst | 417/354 |
| 4,221,546 | 9/1980 | Papst et al. | 417/354 |
| 4,225,285 | 9/1980 | Sturm | 417/354 |
| 4,373,861 | 2/1984 | Papst et al. | 415/213 C |
| 4,428,719 | 1/1984 | Hayashibara et al. | 417/423 R |
| 4,482,302 | 11/1984 | Grignon | 417/354 |
| 4,564,335 | 1/1986 | Harmsen et al. | 417/354 |

FOREIGN PATENT DOCUMENTS

| | | | |
|---|---|---|---|
| 2252415 | 4/1973 | Fed. Rep. of Germany | 417/353 |

*Primary Examiner*—Randolph A. Reese
*Assistant Examiner*—Peter M. Cuomo
*Attorney, Agent, or Firm*—Barnes & Thornburg

[57] ABSTRACT

An axial-flow fan, particularly a small fan which is axially compact, with a scroll plate surrounding the impeller and whose inner contour has a cylindrical configuration in the vicinity of the axial median plane and extends both towards the inlet side and the outlet side in a polygonal, particularly square profile accompanied by the formation of corner areas, and with a central, coaxial core formed by the drive motor, the impeller hub and the mounting flange for the drive motor; the core thereby has an annular surface conically tapering towards the inlet side face whose axial length is at least one-third of the hub length; with respect to the axial median plane, the scroll plate is asymmetrical in the corner areas and is made cylindrical over a longer distance from the axial median plane to the inlet side than to the outlet side.

32 Claims, 10 Drawing Figures

AXIAL-FLOW FAN

This is a continuation of application Ser. No. 516,733, filed July 25, 1983 now abandoned.

BACKGROUND OF THE INVENTION

The present invention relates to an axial-flow fan, particularly to a small fan which is axially compact, with a scroll plate or housing surrounding the impeller and whose inner contour has a cylindrical configuration in the vicinity of the axial median plane and extends both towards the inlet side and the outlet side in a polygonal, particularly square profile describing the impeller diameter and accompanied by the formation of corner areas, and with a central, coaxial core formed by the drive motor, the impeller hub and the mounting flange for the drive motor, whereby the core has a surface conically tapering towards the inlet side.

Such axial-flow fans are used in a preferred manner for cooling electrical and electronic equipment and installations, particularly where very compact fan dimensions and low noise with high air output are required. The dimensions of the fans which can be used in such devices are limited by the available structural space. Thus, it is not possible to increase the dimensions in order to increase the output of such fans.

An axial-flow fan of the aforementioned type is known (DOS No. 29 40 650), in which relatively high air outputs are obtained in that on the inlet side the impeller hub is provided with a ring surface conically tapering towards the end face. The scroll plate is cylindrical in the vicinity of the axial median plane while leaving a small gap to the fan blades and widens to a square shape by walls sloping in the corner areas both towards the inlet side and towards the outlet side and extending symmetrically to the axial median plane.

Due to the fact that in the equipment in question, ever-smaller electrical and/or electronic components are being increasingly used, the casings or housings of such equipment can also be made ever-smaller. This means for the small fans of the type considered herein that the efficiency is limited by the opposing dynamic pressures in the installation areas.

SUMMARY OF THE INVENTION

The task of the present invention is therefore to provide an axial-flow fan, which has a higher efficiency than the known fans of this type and in which this is achieved without increasing the external dimensions of the known fans.

According to the present invention, this problem is solved in that the axial length of the conical annular surface amounts to at least ⅓ of the hub length and in that with respect to the axial median plane, the scroll plate is asymmetrical in the corner areas and is constructed cylindrically over a longer distance from the axial median plane to the inlet side than to the outlet side.

It has been discovered that these measures lead to a considerable improvement in the performance, without having to modify the external dimensions of the axial-flow fans. It has also been found that the improved action does not occur to any noticeable extent, i.e., occurs only barely, unless the axial length of the conical ring surface corresponds to at least one third of the total hub length. Only the combination of the two features mentioned above leads to the surprising improvement, which will be further explained hereinafter. As a result of the measures according to the present invention, on the inlet side a wall is formed over a relatively long path (in the area of the cylindrical configuration of the scroll plate), which surrounds the fan blades in a circular manner even in the corner areas, so that the air drawn in, even in the case of high dynamic pressures on the outlet side, cannot leave the fan blades in a radially outward direction before reaching the half of the air guidance path located on the outlet side.

According to an advantageous further development, the cylindrical portion of the scroll plate passes over into a rounded-off intake portion at the outer edge area directed towards the inlet side. This leads to a wider intake cross section on the inlet side, which passes over only gradually narrowing into the flow duct portion bounded by the cylindrical part of the scroll plate. It is thereby advantageous if the radius of curvature of the rounded intake portion is chosen relatively large and in fact somewhat larger or equal to ⅓ of the distance between the axial median plane and the inlet side.

A similar action can also be obtained if the cylindrical portion of the scroll plate passes over into the inlet side by way of a chamfer. It has also been found that if the scroll plate is cylindrical over the entire distance between the axial median plane and the inlet side, a considerable improvement in output can still be achieved.

BRIEF DESCRIPTION OF THE DRAWINGS

These and other objects, features and advantages of the present invention will become more apparent from the following description when taken in connection with the accompanying drawing which shows, for purposes of illustration only, several embodiments in accordance with the present invention, and wherein.

DETAILED DESCRIPTION OF THE INVENTION

Figure 1:
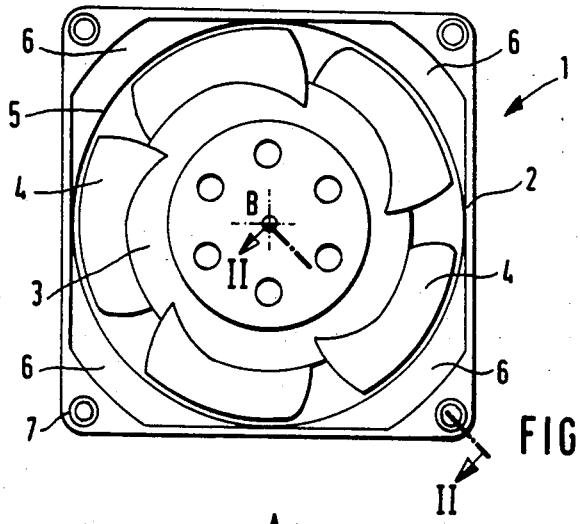
FIG. 1 is an elevational view of the inlet set of an axial-flow fan according to the present invention.

Referring now to the drawing wherein like reference numerals are used to designate corresponding parts in the various thereof, and more particularly to FIG. 1, an axial-flow fan is generally designated in this figure by reference numeral 1 which, as a result of its small external dimensions and compact construction, is preferably used for cooling purposes in electronic or electrical equipment. The impeller is installed into a scroll plate or housing generally designated by reference numeral 2. The fan blades 4 and motor casing 3 can also be seen in FIG. 1.

Viewed over the axial depth, the scroll plate or housing 2 has a partial area, in which it extends cylindrically and concentrically to the fan axis B and is designated by reference numeral 5. From the cylindrical area 5, the scroll plate or housing 2 passes over into a square form in the direction towards the inlet side as also twoards the outlet side, whereby mounting holes 7 are located in the resulting corner areas 6.

Figure 2:
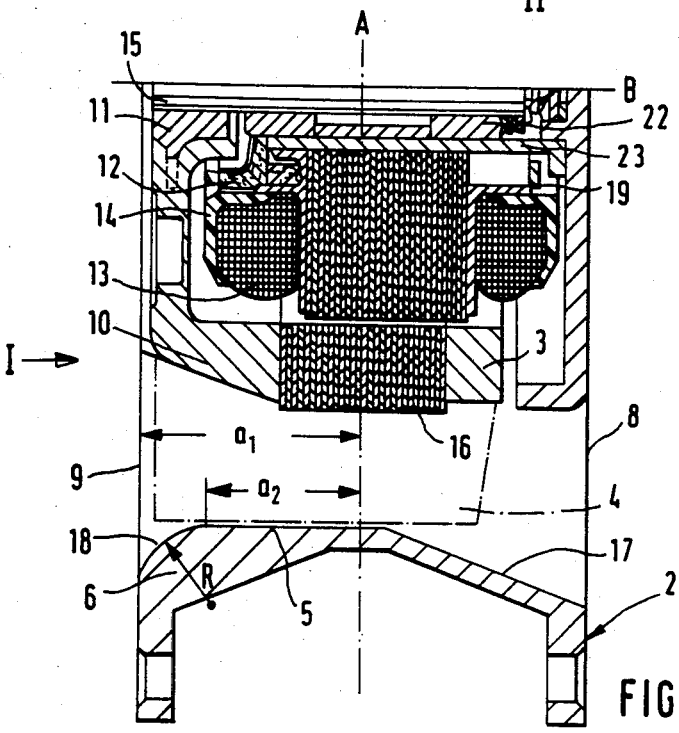
FIG. 2 is a cross-sectional view taken along line II—II through the axial-flow fan of FIG. 1.

The cross section of FIG. 2 through half of an axial fan according to the present invention shows that the motor casing 3, serving as a hub, is provided with an annular surface 10 conically tapering towards the inlet side 9, whereby the fan blades 4 also extend over this annular surface 10. The motor is constructed in a manner known as such. The coil ends 13, which are mounted on a ring 12 and which are sealed off at the front by means of a protective cover 14 made from an insulating material, surround the stator 19, which in turn is supported by means of a tubular member 23 and a sliding bearing 22 with respect to shaft 15. The shaft 15 is fixed to the motor casing 3 by means of the bush 11. Externally, the casing 3 is constructed in one piece as a short-circuit rotor motor, whose bars pass in a manner, known as such, through the laminated plates 16 of the rotor. The fan blades 4 are then fixed to the outer periphery of the motor casing 3, which is constructed as hub.

The cylindrically extending area 5 of the scroll plate 2 delimits the inner space in which the impeller is arranged, in the axial median plane A. Towards the inlet side 9, scroll plate 2 extends over a length $a_2$, which is greater than half the distance $a_1$ from the axial median plane A to the inlet side 9. Towards the outlet side 8, the scroll plate in the corner areas extends from the axial median plane A with a sloping wall 17, so that an overall asymmetrical construction with respect to the axial median plane A between the inlet side half and the outlet side half of the axial-flow fan results. The cylindrical area 5, in the embodiment of FIG. 2, passes over into a rounded-off intake portion 18, whose radius of curvature R is approximately one-third of the distance $a_1$ from the axial median plane A to the inlet side 9. It has been found that if the cylindrically extending area 5 is advanced relatively far up to the inlet side, the fan performance can be improved. This can be attributed to the fact that in the construction according to the present invention, the fan blades 4 are surrounded over a relatively large axial area by the cylindrical area 5 of the scroll plate 2, so that the air seized by the fan blades is unable ahead of the cross-sectional narrowing in the axial median plane, with dynamic pressures prevailing on the outlet side 8, to escape this counterpressure in that the air escapes the movement by the fan blades 4 radially outwardly and would thus be forced again toward the inlet side, as is the case with the known constructions.

Figure 3:
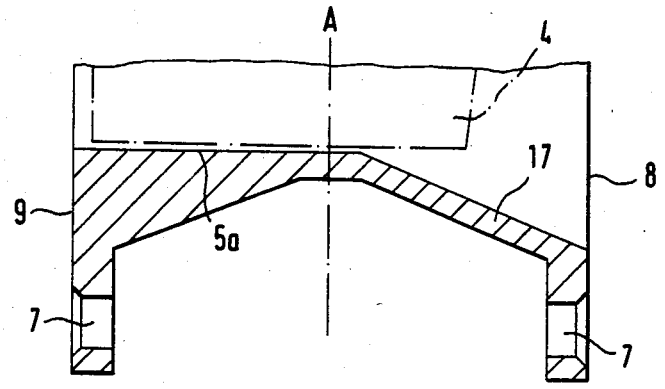
FIG. 3 is a cross-sectional view of a detail of a corner area of a modified construction in accordance with the present invention.
Figure 4:
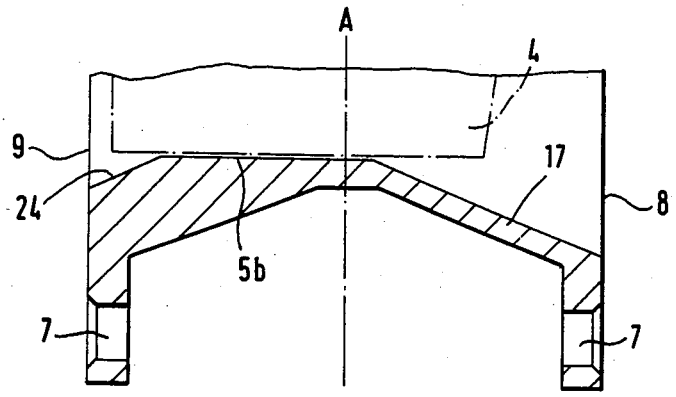
FIG. 4 is a cross-sectional view of a detail of a corner area of still another modified construction in accordance with the present invention.

In the embodiment of FIG. 3, which also shows a cross section through a corner area of the scroll plate, the cylindrical area **5*a* extends over the entire distance between the axial median plane A and the inlet side 9. The output can be increased in this case as also with an axial-flow fan, whose cylindrical area 5*b* passes over into the outer edge area towards the inlet side 9 by way of a chamfer 24 (ef. FIG. 4**), compared with the prior art axial-flow fans.

Figure 5:
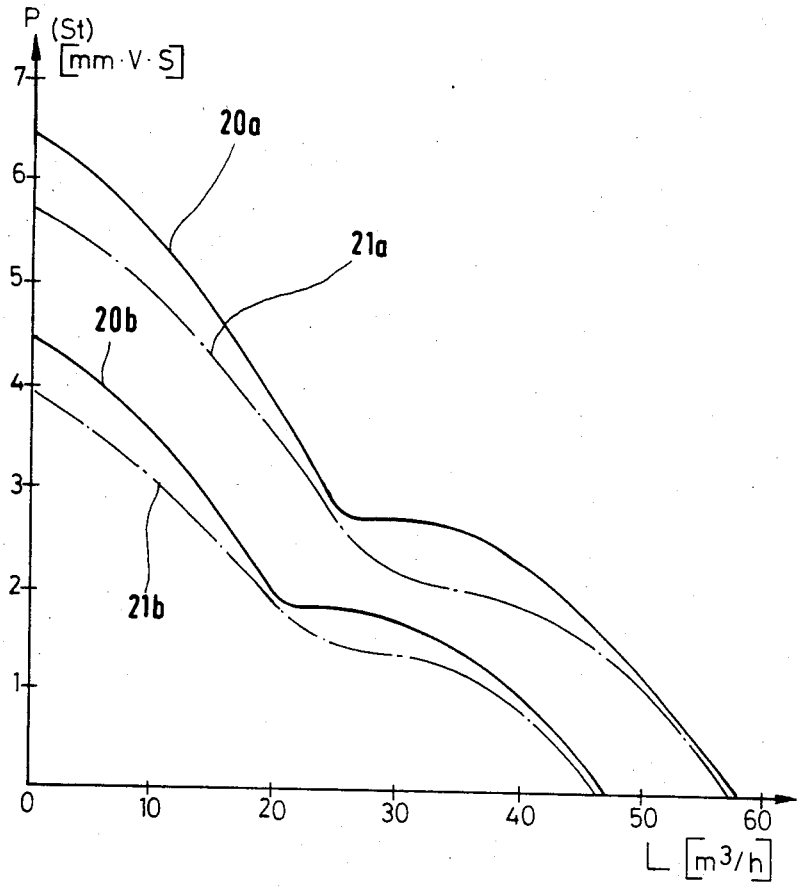
FIG. 5 is a diagram illustrating the curves of the quantity of air against static pressure measured in an axial-flow fan according to the present invention and also in an axial flow fan of the prior art.

FIG. 5 shows the characteristic curves **20*a* and 20*b* of the novel axial-flow fan compared with characteristic curves 21*a* and 21*b* of a prior art fan (DOS 29 40 650); it is apparent from these curves that, particularly in the case of high counterpressures (the pressure is plotted along the ordinate), a considerable improvement in the output and performance can be achieved with the fan according to the present invention. The curve pairs 20*a* and 21*a* as well as 20*b* and 21*b* which belong together, represent thereby comparative measurements, carried out with two different impeller frequencies. The curves 20*a* and 21*a* are plotted at a frequency of 60 Hz, while the curves 20*b* and 21*b*** are plotted at a frequency of 50 Hz. The quantity of air is plotted along the abscissa axis.

It has also been found that an even more marked improvement of the characteristics can be obtained at higher speeds, which is apparent from the greater deviations in the curves **20*a* and 21*a* plotted for a frequency of 60 Hz, as compared with the deviations of curves 20*b* and 21*b*,** plotted at a frequency of only 50 Hz and thus at lower fan speeds. Consequently, the effect according to the present invention occurs in particular in the case of high-speed fans, especially with direct-current fans having a speed over 3000 rpm. These fans are particularly suitable for cooling and ventilating electrical and electronic equipment, as described hereinabove.

Figure 6:
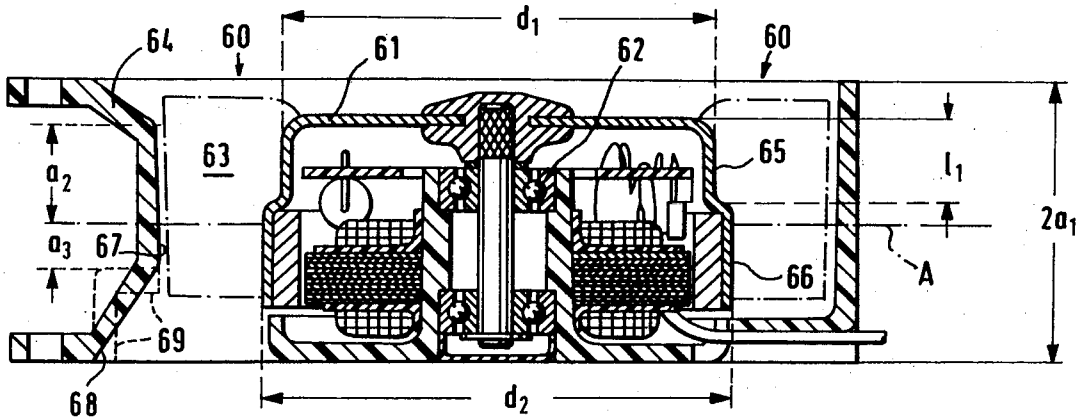
FIG. 6 is a longitudinal axial cross-sectional view, similar to FIG. 4 through an axial fan in accordance with the present invention illustrating two modifications, shown in actual size.

The inlet channel according to FIG. 2 has a circumferential rounded-off edge with a relatively large inlet radius R while in the construction according to FIG. 3 the inlet radius has a theoretical value equal to zero. However, the embodiments according to FIGS. 3 and 2 are alternative to one another, i.e., the present invention so far provides a construction according to FIG. 2 with a relatively large inlet radius 6 having the half-diameter R or a cylindrical surface of the channel up to the inlet plane 9 in FIG. 3. FIG. 4 illustrates only a small widening angle of the cylindrical surface **5*b* toward the inlet side in the form of the cone surface 24; it starts, for example, at ⅛ of the axial housing length from the inlet plane 9 and has a value of about 60°. FIG. 6 now illustrates a modification of the cone surface 10 of FIG. 2** which also forms part of the present invention.

The embodiment of FIG. 6 includes a portion cylindrically offset in the axial area of the closed outer rotor bottom, i.e., reduced in the diameter thereof, having the cylindrical surface 65 which widens step-like after the length $1_1$ to the full rotor diameter $d_2$ of the hub 66. The blades 63 are butt-welded, for example, by condenser discharge onto the rotor can 61 which is deep-drawn of soft magnetic metal so that the alrger cross section exists in the inflow direction 60 (as in the case of the cone 10 of FIG. 2). The rotor pot section 65 which is reduced in diameter, thus acts like a strongly defined inlet cone of the rotor hub or of the flange—whichever exists in the center on the inlet side.

The channel wall 67 which only for manufacturer tolerances is not exactly cylindrical, extends toward the inlet side from the center plane A by a distance $a_2$ which is significantly larger than the axially cylindrical length of the channel wall 67. On the outlet side, the cylindrical wall 67 now passes over in the square corner areas (in axial plan view on the housing according to FIG. 1) into the channel enlargement with the wall contour 68 (like the wall 17 in the case of FIGS. 2, 3 and 4); this feature can be varied in a further modification in that in lieu of the inclined corner walls 68 (which is a coaxial cone surface only is special cases), one provides radially and axially extending walls 69 which form complete corner pockets as a result of their sudden strong widening in the mentioned corner areas whereas in the case of the gradual transition by the inclined corner walls 68, something like a "half-corner pocket" is formed. The variation of the inlet contour of the housing according to FIGS. 2, 3 and 4 is also possible in the case of FIGS. 6, 7 and 8. However, the shape illustrated in FIG. 6 is optimized with a view toward manufacture, noise and output; on the other hand, the variations of the outlet channel configuration (FIGS. 2, 3, and 4—reference numeral 17) can also be replaced by a contour corresponding to the walls 69—FIG. 6.

It is mportant for the present invention that a maximum cross section is available in the inlet area, above all that a cross-sectional enlargement about the rotor hub is attained, and that on the outlet side as large as possible an enlargement of the flow cross section is attained by the channel walls 67, respectively, 68 or 69 and the hub contour 66 whereby the ratio of the lengths $a_2+a_3/2a_1$ should have a minimum value of about 0.3, preferably about 0.5. The optimum at 0.5, however, is not sharply defined. If, for example, for manufacturing reasons, one cannot make the diameter of the rotor, i.e., the outer diameter of the rotor blade 63 sufficiently close to the inner diameter of the walls 67, the ratio $a_2+a_3/2a_1$ must be larger. It may then, for example, lie optimally at about 0.6.

The ratio $l_1/2a_1$ has a minimum value of 0.3.

Figure 7:
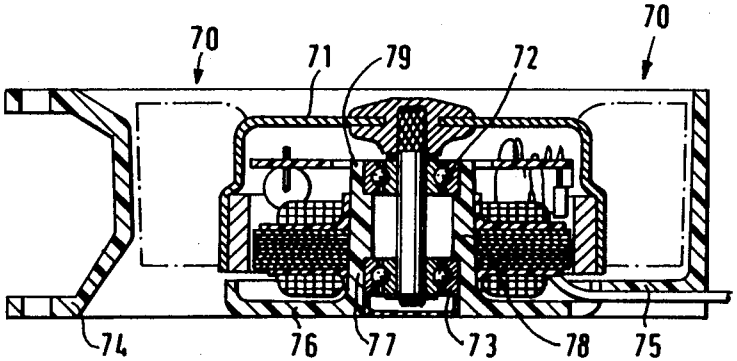
FIG. 7 is a cross-sectional view, similar to FIG. 6, of a smaller version, also in actual size and illustrating certain constructive details thereof.

FIG. 7 illustrates further details which are more clearly visible by the cross-hatching. In this figure, one can see the housing with the outer annular wall 74 which passes over into square fastening lugs corresponding to the illustration in FIG. 1 in one-piece with the fastening webs 75 and flange 76 as well as the bearing tube 77, 78 and 79. More particularly, the entire structure is a one-piece plastic die-casting or molded part, preferably with an interior width enlarged in the diameter with respect to the center part 78 within the area of the bearings 72 and 73 of the plastic bearing tube [for the installation of the bearing]. Because the fan of the present invention is driven by a collectorless d.c. motor, especially a so-called two-pulse motor, particularly if one deals with a fan of small dimensions as shown in its actual size in FIG. 7 and even smaller, it is not easy to accommodate the electronics in the motor area, i.e., either in the flange 76 or as in the case of FIG. 7, within the area of the closed rotor bottom 71.

With collectorless d.c. fans with one- or two-pulsed operation, one uses particularly few electronic elements and the latter can be favorably accommodated in the drive hub of the fan. At the same time, they produce relatively little heat so that with a collectorless d.c. motor for the drive of the fan, the bearing tube 77, 78 and 79 can be made of plastic material, particularly with a one- or two-pulsed collectorless d.c. motor. The plastic bearing tube has sufficient durability and maintains the tolerance over a long length of life because the heating from the motor loses and the electronics is so small that one can provide a plastic bearing support tube for the bearing and very advantageously can make the same economically in one piece with the remaining housing.

Figure 8:
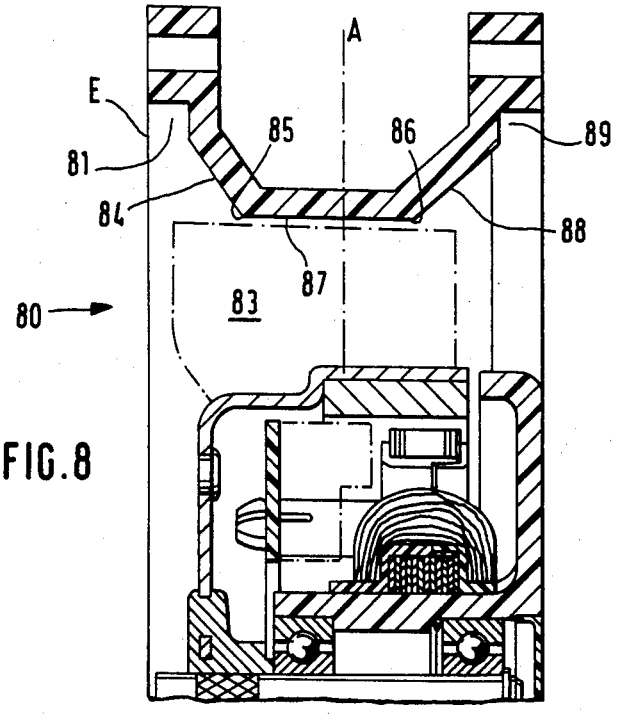
FIG. 8 is a cross-sectional view through a still further modified embodiment of an axial fan in accordance with the present invention.

FIG. 8 illustrates a similar construction as FIG. 6 and 7 with offset-like pockets 81 and 80 on the inlet and outlet plane, with sloping corner walls 84 on the inlet side and sloping corner walls 88 on the outlet side. It is again decisive that the point of transition 85 from the widening wall 84 into the cylindrical wall 87 on the inlet side is at a greater distance from the center plane A than the point 86 where the transition takes place on the outlet side from the cylinder wall 87 into the corner enlargement wall 88. The offset recess which leads to the formation of the corner pockets 81 and 89 is favorable from a manufacturing point of view and assures a better maintenance of the dimensions of the one-piece plastic housing which, as to the rest, is constructed as in FIG. 7; namely, in one piece inclusive the bearing tube and consisting of plastic material.

Figure 9:
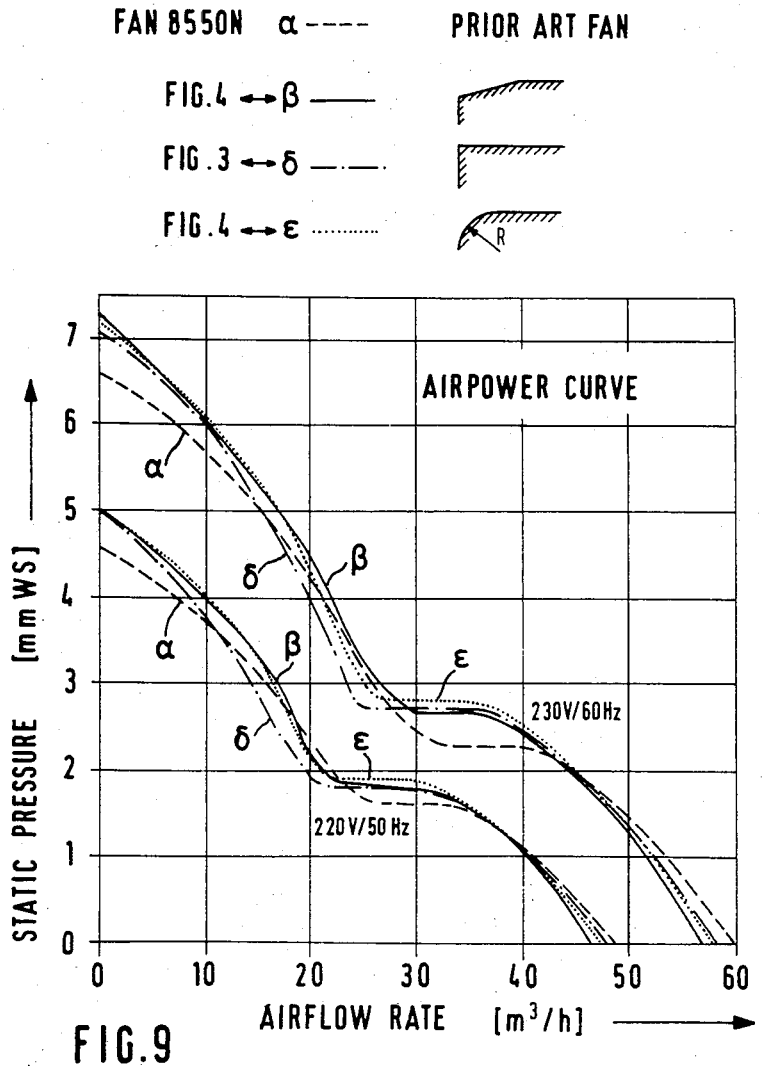
FIG. 9 is a diagram of air output curves for two different rotational speed ranges.

FIG. 9 illustrates clearly that a small widening into the corners on the inlet side, as shown to scale in FIG. 4, entails a very advantageous configuration of the curve at a slightly higher pressure requirement while with decided maximum pressure, the differences from the different contour of the inlet opening disappear, but in the middle pressure range where the practical applications lie, a relatively large radius of curvature of the circumferential contour (as indicated in FIG. 2) clearly produces still an additional improvement.

In particular, it can be seen that tha asymmetry of the outer housing, as viewed from the center plane A, in conjunction with the inlet cone (for example according to FIG. 2 or also in the modification according to FIGS. 6, 7 and 8) is very favorable (difference of curve $\alpha$ from curves $\beta$, $\delta$ and $\epsilon$). The curve $\alpha$ corresponds to a symmetrical housing whereby a pronounced cone hub was also provided in the inflow area, as described in the Japanese Patent Application No. 54/133638 or in the U.S. Pat. No. 4,373,861.

Figure 10:
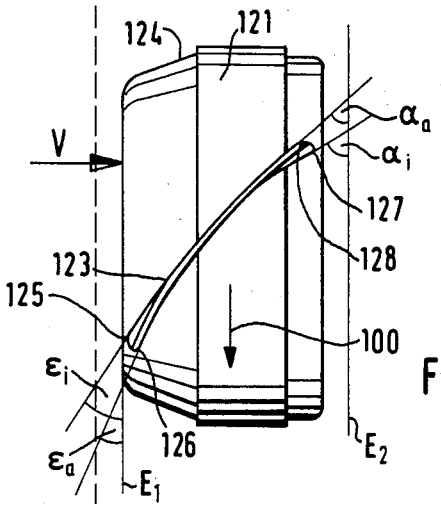
FIG. 10 is a radial plan view on a rotor blade whereby only a single blade is shown in order to clearly define the blade.

One obtains generally a further improvement of the characteristic curve and also of the noise if one constructs the contour of the blades 23, respectively, 83, 63, 73 or 123 as shown in FIG. 10 in such a manner that the angle at the blade root on the inlet side $\epsilon_i$ which is formed by the tangent to the blade root on the inlet side (i.e., at the blade surface thereat) and the inflow plane (as also to any of the other planes which are parallel to the inflow plane which may be E, $E_1$, $E_2$) is smaller than the angle $\alpha_i$ on the outlet side (at the blade root). The blade angle $\epsilon_a$ at the radial outside on the inlet side (formed again by the tangent to this blade edge and its angle to the inlet plane) is smaller than the blade angle at the radial outer edge on the outlet side $\alpha_a$. In other words $\epsilon_i$ is smaller than $\alpha_i$ and $\epsilon_a$ is smaller than $\alpha_a$, whereby the conditions, as illustrated in FIG. 10, are optimal for a fan according to FIG. 2, i.e., for FIGS. 1, 2, 3 and 4 and similar conditions are valid in the case of FIGS. 6, 7 and 8; however, $\alpha_i$ is approximately equal to $\alpha_a$ in that case.

The blade curvature is approximately that of a cylindrical surface. In all of these cases, the angle $\epsilon_i$ passes over continuously into the angle $\epsilon_a$ and the angle $\alpha_i$ into the angle $\alpha_a$ in the approximately radially directed contour of the inlet and outlet edges. The true radial extent of the blades has to be considered thereby, and it is to be taken into consideration in this case that FIG. 1 is shown approximately in actual size whereas FIG. 2 is shown enlarged by about 1.5 as also FIGS. 3 and 4, and that FIGS. 6 and 7 are shown in their actual size whereas FIG. 8 illustrated in twice its size. FIG. 10, shown in its actual size, belongs to FIGS. 2 and 1.

While I have shown and described several embidments in accordance with the present invention, it is understood that the same is not limited thereto but is susceptible of numerous changes and modifications as known to those skilled in the art, and we therefore do not wish to be limited to the details shown and described herein, but intend to cover all such changes and modifications as are encompassed by the scope of the appended claims.

I claim:

1. An axial-flow fan comprising a drive motor means, a scroll plate means surrounding an impeller means having a hub, an inner contour of said scroll plate means having a cylindrical configuration in a vicinity of an axial median plane of the fan and extending towards an inlet side of the fan and with an outlet side of the scroll plate means formed into a polygonal profile circumscribing an impeller diameter and accompanied by formation of corner areas, and a central, coaxial core means formed by the drive motor means, the impeller hub and a mounting flange for the drive motor means, said core means having an annular surface reduced in diameter towards the inlet side, the annular surface having an axial length at least about one-third of a length of the hub, and with respect to the axial median plane, the scroll plate means being asymmetrical in the corner areas and being cylindrical over a longer distance from the axial medial plane to the inlet side than to the outlet side and wherein the impeller means has an outside edge which extends from the inlet side of the fan into the corner areas.

2. An axial-flow fan according to claim 1, wherein the cylindrical portion of the scroll plate means extends for a distance which is at least half the distance between the axial median plane and the inlet side.

3. An axial-flow fan according to claim 2, wherein the scroll plate means passes over from its cylindrical area ito a rounded-off intake portion along an outer edge area directed towards the inlet side.

4. An axial-flow fan according to claim 3, wherein a radius of curvature of the rounded-off intake portion is equal to or greater than one-third of the distance between the axial median plane and the inlet side.

5. An axial-flow according to claim 2, wherein the cylindrical area of the scroll plate means passes over in the corner areas thereof into a chamfer in the direction towards the inlet side.

6. An axial-flow fan according to claim 2, wherein the scroll plate means is cylindrical over the entire distance between the axial median plane and the inlet side.

7. An axial-flow fan according to claim 1, wherein the scroll plate means passes over from its cylindrical area into a rounded-off intake portion along an outer edge area directed towards the inlet side.

8. An axial-flow fan according to claim 7, wherein a radius of curvature of the rounded-off intake portion is equal to or greater than one-third of the distance between the axial median plane and the inlet side.

9. An axial-flow fan according to claim 1, wherein the cylindrical area of the scroll plate means passes over in the corner areas thereof, into a chamfer in the direction towards the inlet side.

10. An axial-flow fan according to claim 1, wherein the scroll plate means is cylindrical over the entire distance between the axial median plane and the inlet side.

11. An axial-flow fan according to claim 1, wherein the drive motor is a collectorless d.c. motor in which electronics for a commutation is arranged within an area of the motor.

12. An axial fan according to claim 11, in which the collectorless d.c. motor is a motor with permanent magnet rotor and operated either in a one- or two-pulsed manner.

13. An axial fan according to claim 11 having a square housing, as viewed in axial plan view, with a contour of less than 100 mm. in length of each side of the square and an axial length of at most 32 mm.

14. An axial fan according to claim 1, wherein the central coaxial core means is formed on the inlet side with a stepwise reduction of an outer diameter of the outer rotor within the area of the closed rotor bottom surface.

15. An axial fan according to claim 14, in which on the outlet side step-like enlargements are provided in the corner areas of the scroll plate means in order to form offset corner pockets.

16. An axial fan according to claim 1, in which on the outlet side step-like enlargements are provided in the corner areas of the scroll plate means in order to form offset corner pockets.

17. An axial fan according to claim 1, in which offset recesses are provided on at least one of the inlet and outlet side within the corner areas of the scroll plate means.

18. An axial fan according to claim 1, wherein the fan has an inlet blade angle $epsilon_i$, $epsilon_a$ smaller than its outlet blade angle $alpha_i$, $alpha_a$.

19. An axial fan according to claim 18, where epsilon is about 30° to 50° and alpha is about 40° to 60° and $alpha_i$ about equal to $\alpha_a$.

20. An axial-flow fan, comprising a drive motor, a scroll plate means surrounding an impeller having a hub, an inner contour of said scroll plate means having a cylindrical configuration in a vicinity of an axial median plane and being widened towards an inlet side of the fan and with an outlet side of the scroll plate means formed into a polygonal profile circumscribing an impeller diameter accompanied by formation of corner areas, and a central, coaxial core means formed by the drive motor, the impeller hub and a mounting flange for the drive motor means, said core means having an outer annular surface tapering towards the inlet side so that an inlet channel tapering in the direction of air flow is formed, the annular surface having an axial length which amounts to at least one-third of a length of the hub, the scroll plate means being constructed asymmetrically in the corner areas with respect to the axial median plane and cylindrically over a longer distance from the axial median plane to the inlet side than to the outlet side and wherein the impeller means has an outside edge which extends from the inlet side of the fan into the corner areas.

21. An axial-flow fan according to claim 20, wherein the fan is a relatively small fan with axial compactness.

22. An axial-flow fan according to claim 20, wherein the distance of the cylindrical portion of the scroll plate means is at least half the distance between the axial median plane and the inlet side.

23. An axial-flow fan according to claim 22, wherein the scroll plate means passes over from its cylindrical area into a rounded-off intake portion along an outer edge area directed towards the inlet side.

24. An axial-flow fan according to claim 23, wherein a radius of curvature of the rounded-off intake portion is equal to or greater than one-third of the distance between the axial median plane and the inlet side.

25. An axial-flow fan according to claim 20, wherein the cylindrical area of the scroll plate means passes over in the corner areas thereof into a chamfer in the direction towards the inlet side.

26. An axial-flow fan according to claim 20, wherein the scroll plate means is cylindrical over the entire distance between the axial median plane and the inlet side.

27. An axial-flow fan according to claim 20, wherein the central core means is formed on the inlet side with a stepwise reduction of an outer diameter of the hub.

28. An axial-flow fan according to claim 20, wherein the polygonal profile is a substantially square profile.

29. An axial-flow fan comprising a drive motor means, a scroll plate means surrounding an impeller means having a hub, an inner contour of said scroll plate means having a cylindrical configuration in a vicinity of an axial median plane of the fan and extending towards an inlet side of the fan and with an outlet side of the scroll plate means formed into a polygonal profile circumscribing an impeller diameter and accompanied by formation of corner areas, and a central, coaxial core means formed by the drive motor means, the impeller hub and a mounting flange for the drive motor means, said core means having an annular surface reduced in diameter towards the inlet side, the annular surface having an axial length extending for a given distance along the length of the hub, and with respect to the axial median plane, the scroll plate means being asymmetrical in the corner areas and being cylindrical over a longer distance from the axial medial plane to the inlet side than to the outlet side and wherein the impeller means has an outside edge which extends from an area adjacent the inlet side of the fan into the corner areas.

30. An axial-flow fan comprising a drive motor means, a scroll plate means surrounding an impeller means having a hub, an inner contour of said scroll plate means having a cylindrical configuration in a vicinity of an axial median plane of the fan and extending towards an inlet side of the fan and with an outlet side of the scroll plate means formed into a polygonal profile circumscribing an impeller diameter and accompanied by formation of corner areas, and a central, coaxial core means formed by the drive motor means, the impeller hub and a mounting flange for the drive motor means, said core means having an annular surface reduced in diameter towards the inlet side, the annular surface having an axial length extending for a given distance along the length of the hub, and with respect to the axial median plane, the scroll plate means being asymmetrical in the corner areas and being cylindrical over a longer distance from the axial medial plane to the inlet side than to the outlet side and wherein the impeller means has an outside edge which in length is greater than the cylindrical length portion of the scroll plate.

31. An axial-flow fan, comprising a drive motor, a scroll plate means surrounding an impeller having a hub, an inner contour of said scroll plate means having a cylindrical configuration in a vicinity of an axial median plane and being widened towards an inlet side of the fan and with an outlet side of the scroll plate means formed into a polygonal profile circumscribing an impeller diameter accompanied by formation of corner areas, and a central, coaxial core means formed by the drive motor, the impeller hub and a mounting flange for the drive motor means, said core means having an outer annular surface tapering towards the inlet side so that an inlet channel tapering in the direction of air flow is formed, th annular surface having an axial length which extending for a given distance along the a length of the hub, the scroll plate means being constructed asymmetrically in the corner areas with respect to the axial median plane and cylindrically over a longer distance from the axial median plane to the inlet side than to the outlet side and wherein the impeller means has an outside edge which extends from an area adjacent the inlet side of the fan into the corner areas.

32. An axial-flow fan, comprising a drive motor, a scroll plate means surrounding an impeller having ahub, an inner contour of said scroll plate means having a cylindrical configuration in a vicinity of an axial median plane and being widened towards an inlet side of the fan and with an outlet side of the scroll plate means formed into a polygonal profile circumscribing an impeller diameter accompanied by formation of corner areas, and a central, coaxial core means formed by the drive motor, the impeller hub and a mounting flange for the drive motor means, said core means having an outer annular surface tapering towards the inlet side so that an inlet channel tapering in the direction of air flow is formed, the annular surface having an axial length which extending for a given distance along the length of the hub, the scroll plate means being constructed asymmetrically in the corner areas with respect to the axial median plane and cylindrically over a longer distance from the axial median plane to the inlet side than to the outlet side and wherein the impeller means has an outside edge which in length is greater than the cylindrical length portion of the scroll plate.

* * * * *